US006231305B1

(12) United States Patent
Kupka et al.

(10) Patent No.: US 6,231,305 B1
(45) Date of Patent: May 15, 2001

(54) STEAM TURBINE INSTALLATION

(75) Inventors: Wolfgang Kupka, Goerlitz; Helmut Kühn, Mengelsdorf; Dietrich Hintze, Kunnerwitz; Jürgen Kraft, Girbigsdorf, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/444,964

(22) Filed: Nov. 22, 1999

Related U.S. Application Data

(63) Continuation of application No. PCT/DE98/01297, filed on May 8, 1998.

(30) Foreign Application Priority Data

May 21, 1997 (DE) ..... 197 21 317

(51) Int. Cl.[7] ..... F01D 25/26
(52) U.S. Cl. ..... 415/213.1
(58) Field of Search ..... 415/213.1, 214.1, 415/108, 229; 248/678, 679

(56) References Cited

U.S. PATENT DOCUMENTS 2,643,078 * 6/1953 Brown et al. ..... 415/213.1
3,808,819 * 5/1974 Engekle et al. ..... 60/690
5,108,258 * 4/1992 Gros ..... 415/213.1

* cited by examiner

*Primary Examiner*—Edward K. Look
*Assistant Examiner*—James M. McAleenan
(74) *Attorney, Agent, or Firm*—Herbert L. Lerner; Laurence A. Greenberg; Werner H. Stemer

(57) ABSTRACT

The steam turbine has an exhaust steam housing and a turbine rotor mounted in an end bearing. The turbine installation is intended to have a high stability with respect to movements of the exhaust steam housing, with a particularly high rigidity of the end bearing. For this purpose, the end bearing is held by a support guided through the exhaust steam housing and supported on a foundation block. In a steam turbine installation having a steam turbine of this type, a condenser assigned to the steam turbine is detachably but rigidly connected to the exhaust steam housing.

4 Claims, 3 Drawing Sheets

STEAM TURBINE INSTALLATION

CROSS-REFERENCE TO RELATED APPLICATION

This is a continuation of copending International Application PCT/DE98/01297, filed May 8, 1998, which designated the United States.

BACKGROUND OF THE INVENTION

Field of the Invention:

The invention relates to a steam turbine installation having a steam turbine whose turbine rotor is mounted in an end bearing.

A steam turbine is normally used in a power plant installation to drive a generator or in an industrial installation to drive a working machine. For this purpose, the steam turbine is fed with steam, serving as a flow medium, which expands in the steam turbine and produces work. Following its expansion the steam usually passes via an exhaust steam housing of the steam turbine into a condenser that is arranged downstream of the latter and in which the steam condenses. The flow through the exhaust steam housing may be axial or radial. The condensate is then fed as feed water to a steam generator and, following its evaporation, passes again into the steam turbine, so that a closed water/steam loop is produced.

The turbine rotor of a steam turbine of this type is normally mounted in a number of axial and/or radial bearings. One of these bearings, also referred to as the end bearing, is arranged in the interior, for example in the inner hub, of the exhaust steam housing and is used to fix that end of the shaft of the turbine rotor which is located in the exhaust steam housing. The end bearing is normally constructed as a radial bearing, that is to say as a bearing that absorbs radial forces.

Commonly assigned, copending application Ser. No. 09/009,560 (German patent application DE 196 15 011 A1) discloses a steam turbine in which a bearing housing formed of bearing shells or halves and belonging to the end bearing of the turbine rotor is directly connected to the exhaust steam housing. For this purpose, the bearing housing of the end bearing is held centrally in the exhaust steam housing via supporting arms that are arranged radially. The bearing housing of the end bearing is arranged inside that spatial area through which steam flows during the operation of the steam turbine. However, the end bearing of a steam turbine designed in this way is particularly sensitive with regard to movements or stresses of the exhaust steam housing, for example from load changes. In addition, in the case of such a design, only a limited rigidity of the end bearing can be achieved. The arrangement of the bearing housing of the end bearing within the flow of steam also requires a high outlay in the sealing of the oil chamber with respect to the spatial area through which the steam flows.

SUMMARY OF THE INVENTION

The invention is therefore based on the object of specifying a steam turbine installation of the above-mentioned type whose steam turbine has a high stability with respect to movements of the exhaust steam housing, with a particularly high rigidity of the end bearing. In addition, the intention is to permit the condenser to be erected without using a cellar or on level ground, with a particularly low outlay.

With the foregoing objects in view there is provided, in accordance with the invention, a steam turbine installation, comprising:

a steam turbine having an exhaust steam housing and a turbine rotor rotatably supported about a rotor axis in the exhaust steam housing;

a foundation block disposed below the exhaust steam housing and a support disposed on the foundation block and guided through and into the exhaust steam housing;

an end bearing rotatably supporting the turbine rotor on the support;

a plurality of supports disposed laterally of the exhaust steam housing substantially at an equal level with the rotor axis of the turbine rotor; and a condenser detachably and rigidly connected to the exhaust steam housing and mounted in the supports.

In other words, the objects of the invention are satisfied by the end bearing which is held by a support guided through the exhaust steam housing of the steam turbine and supported on a foundation block. Further, the exhaust steam housing is detachably but rigidly connected to a condenser assigned to the steam turbine and the condenser is mounted in a number of supports which are arranged geodetically at the level of the main axis of the turbine rotor.

The invention is based on the consideration that, for high stability with respect to the movements of the exhaust steam housing, the end bearing should be decoupled mechanically from the latter. In addition, for high bearing rigidity, a mechanical connection of the end bearing to the foundation or base frame of the steam turbine should be provided. This can be achieved by a support for the end bearing being provided and, in turn, being supported directly on the foundation block.

The end bearing can be arranged in an inner hub of the exhaust steam housing.

The erection of the condenser without a cellar or on level ground is in this case permitted, while avoiding an unfavorable pressure loss, by dispensing with a bypass line which is usually connected between the steam turbine and the condenser. For this purpose, the condenser is connected directly to the turbine housing. The connection between the turbine housing and condenser should be particularly rigid in this case, in order to absorb frictional forces, in particular in the case of a different expansion behavior of turbine housing and condenser.

If the supports are arranged at the level of the turbine axis, thermal expansion of the steam turbine installation leads to a displacement of the condenser relative to its foundation, without any displacements in the vertical direction being able to occur. In order to particularly facilitate the displacement of the condenser in the horizontal direction, in order to avoid damage arising from thermal expansion, a multiple ball bearing is advantageously provided to mount the condenser.

In accordance with an added feature of the invention, the exhaust steam housing includes a plurality of pads each mounted in a respective sliding bearing.

In other words, the exhaust steam housing is expediently supported on the foundation via a number of pads arranged laterally on the exhaust steam housing. In this case, the pads should be arranged laterally on the exhaust steam housing in such a way that they absorb the torque on the exhaust steam housing caused by the turbine rotor, on account of being mounted in a respective sliding bearing. The turbine housing is in this case held at the center of the shaft by central guides at its front end and at its rear end. As a result of using sliding bearings to mount the pads, the steam turbine can be designed in such a way that thermal movements transversely with respect to the main axis of the turbine shaft arising from thermal expansion, for example in the case of a load change, do not lead to damage on the steam turbine.

In accordance with a concomitant feature of the invention, the condenser comprises a plurality of condenser elements with at least one pair of condenser elements disposed opposite one another on the exhaust steam housing. This is a configuration of the steam turbine installation which is particularly symmetrical and therefore particularly insensitive to thermal expansions.

The advantages achieved with the invention are in particular that, as a result of holding the end bearing directly on the foundation, particularly high rigidity of the end bearing can be achieved with particularly simple means. In addition, the end bearing is mechanically decoupled from the exhaust steam housing and is then therefore insensitive with respect to movements of the exhaust steam housing. As a result of holding the end bearing directly on the foundation, the bearing housing can moreover be arranged within a duct region, and therefore outside the spatial region through which steam flows. In this case, the outlay relating to sealing the end bearing with respect to the spatial area through which steam flows is particularly low.

As a result of the displaceable mounting of the condenser or of the condenser elements on the foundation, compensation for thermal expansions arising from load changes on the steam turbine is permitted in a particularly simple way, even when there is a rigid connection between the condenser and the turbine housing. It is thus possible to erect the condenser without a cellar or on level ground, even when a bypass line providing force decoupling between the condenser and the steam turbine is dispensed with.

Other features which are considered as characteristic for the invention are set forth in the appended claims.

Although the invention is illustrated and described herein as embodied in a steam turbine installation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

Functionally and structurally identical parts are identified with the same reference symbols throughout the figures.

DESCRIPTION OF THE PREFERRED EMBODIMENTS

Figure 1:
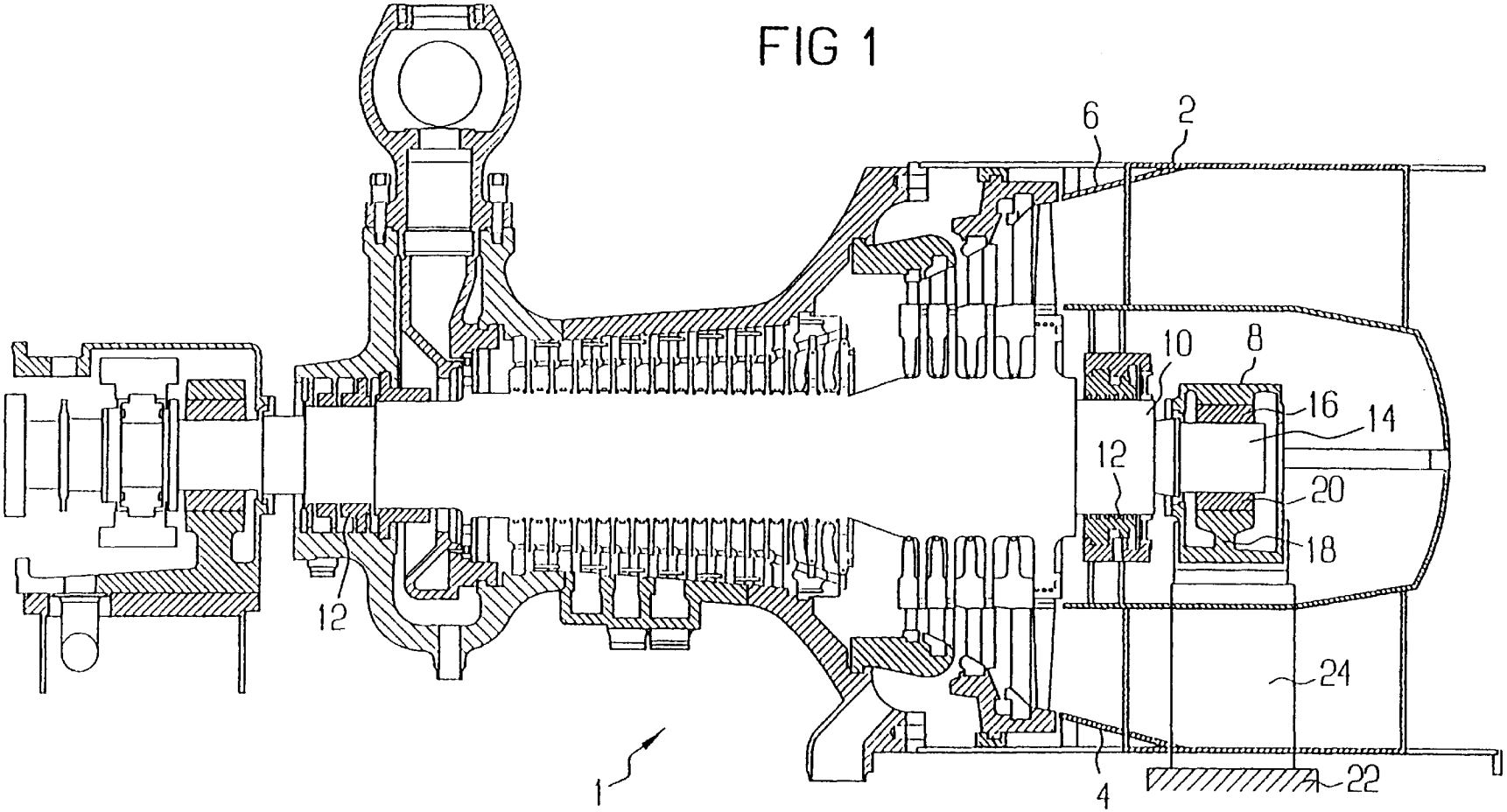
FIG. 1 is a schematic longitudinal section through a steam turbine.

Referring now to the figures of the drawing in detail and first, particularly, to FIG. 1 thereof, there is seen a steam turbine 1 with an exhaust steam housing 2, through which the steam expanded in the steam turbine 1 can be fed to a condenser which is connected downstream of the steam turbine 1. The condenser is not essential to the invention and it is therefore not specifically illustrated in FIG. 1. The exhaust steam housing 2 is composed of a lower housing component 4 and an upper housing component 6. The lower housing component 4 and the upper housing component 6 are in each case designed in one piece and in welded construction. In the exemplary embodiment, the steam turbine 1 is provided for use as an industrial turbine and designed for a mechanical output of about 6 to 8 MW. Alternatively, however, the steam turbine 1 can also be provided for use as a power-plant turbine with a comparatively higher mechanical output.

An end bearing 8 is disposed inside the exhaust steam housing 2. The end bearing 8 is a radial bearing that supports the turbine rotor 10 of the steam turbine 1. In addition, the turbine rotor 10 is mounted so that it can rotate about its mid-axis 14 or rotor axis 14 in a number of further bearings 12, which may be designed as radial and/or axial bearings. The end bearing 8, arranged in an inner hub, comprises bearing parts 16, 18, which together form a bearing housing for the actual bearing 20 of the end bearing 8. Further details relating to the configuration of the end bearing 8 and of the associated sealing arrangement can likewise be seen from FIG. 1; however, they will not be explained at this point, for reasons of clarity.

Figure 2:
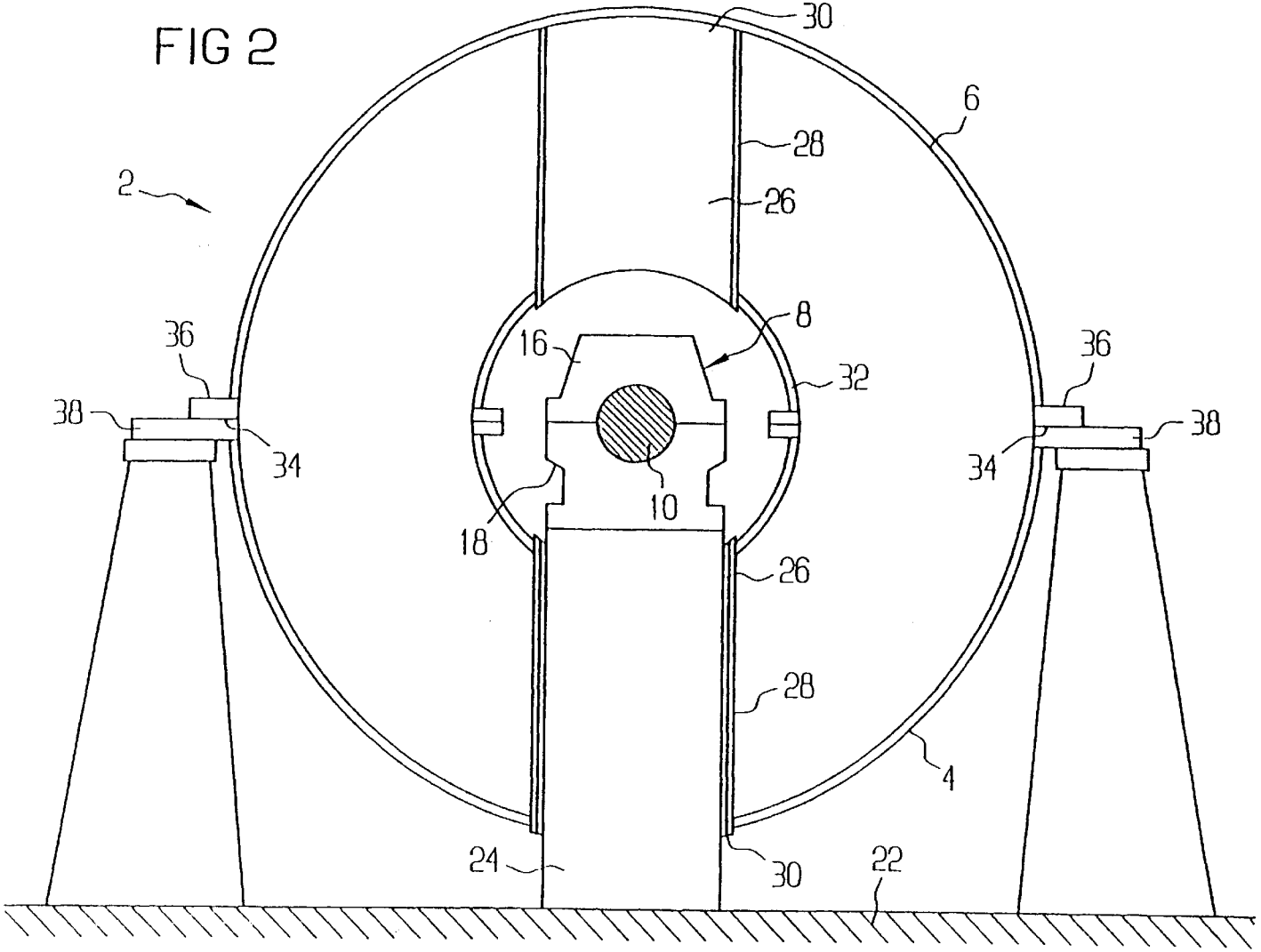
FIG. 2 is a cross-sectional view of an exhaust steam housing.

As can be seen from FIG. 1 and in particular also from FIG. 2, the end bearing 8 is held by a support 24 guided through the lower housing component 4 of the exhaust steam housing 2 and supported on a foundation block 22. For this purpose, the bearing part 18 is rigidly connected to the support 24.

For sealing purposes, the support 24, as illustrated in FIG. 2, is arranged in the interior 26 of a central rib 28 arranged in the interior of the exhaust steam housing 2.

The central rib 28 is led through the exhaust steam housing 2 in the manner of a duct. The interior 26 of the central rib 28 communicates with the surrounding atmosphere via openings 30. The bearing housing of the end bearing 8, formed by the bearing parts 16, 18, is arranged within a duct region 32, which is designed as an inner hub and thickened by comparison with the central rib 28. It is therefore arranged outside the spatial region through which steam flows. In this case, the outlay relating to sealing the end bearing 8 with respect to the spatial region through which steam flows is particularly low.

The lower housing component 4 and the upper housing component 6 are in each case designed as a half-shell and are put together in a joining plane 34 in order to form the exhaust steam housing 2. For installation or inspection purposes, the housing components 4, 6 are each provided with suspension means 36. In addition, a number of pads 38 are arranged on the lower housing component 4 of the exhaust steam housing 2, each of these pads being mounted in a sliding bearing. The pads 38 are arranged laterally on the exhaust steam housing 2 in such a way that, on account of their mounting in the respective sliding bearing, they absorb the torques applied by the turbine rotor 10 during the operation of the steam turbine 1.

The fact that the end bearing 8 is held via the supports 24 directly on the foundation block 22, ensures particularly high rigidity of the end bearing 8 with particularly simple means. In addition, the end bearing 8 is decoupled mechanically from the exhaust steam housing 2 and is thus insensitive to movements of the exhaust steam housing 2 during the operation of the steam turbine 1. The mounting of the exhaust steam housing 2 in the sliding bearings by means of the pads 38 additionally ensures compensation for torques from the turbine rotor 10. As a result of the use of sliding bearings for mounting the pads 38, the steam turbine 1 is designed in such a way that thermal movements transversely with respect to the mid-axis 14 of the turbine rotor 10 arising from thermal expansion, for example in the event of a load change, do not lead to damage on the steam turbine 1. In addition, the pads 38 enable far-reaching preassembly of the steam turbine 1 at the production site.

In order to install the steam turbine 1 and, in particular, its exhaust steam housing 2, a centered fixing of the exhaust steam housing 2 and of the end bearing 8 is provided by means of a vertical projecting guide, not specifically illustrated.

Figure 3:
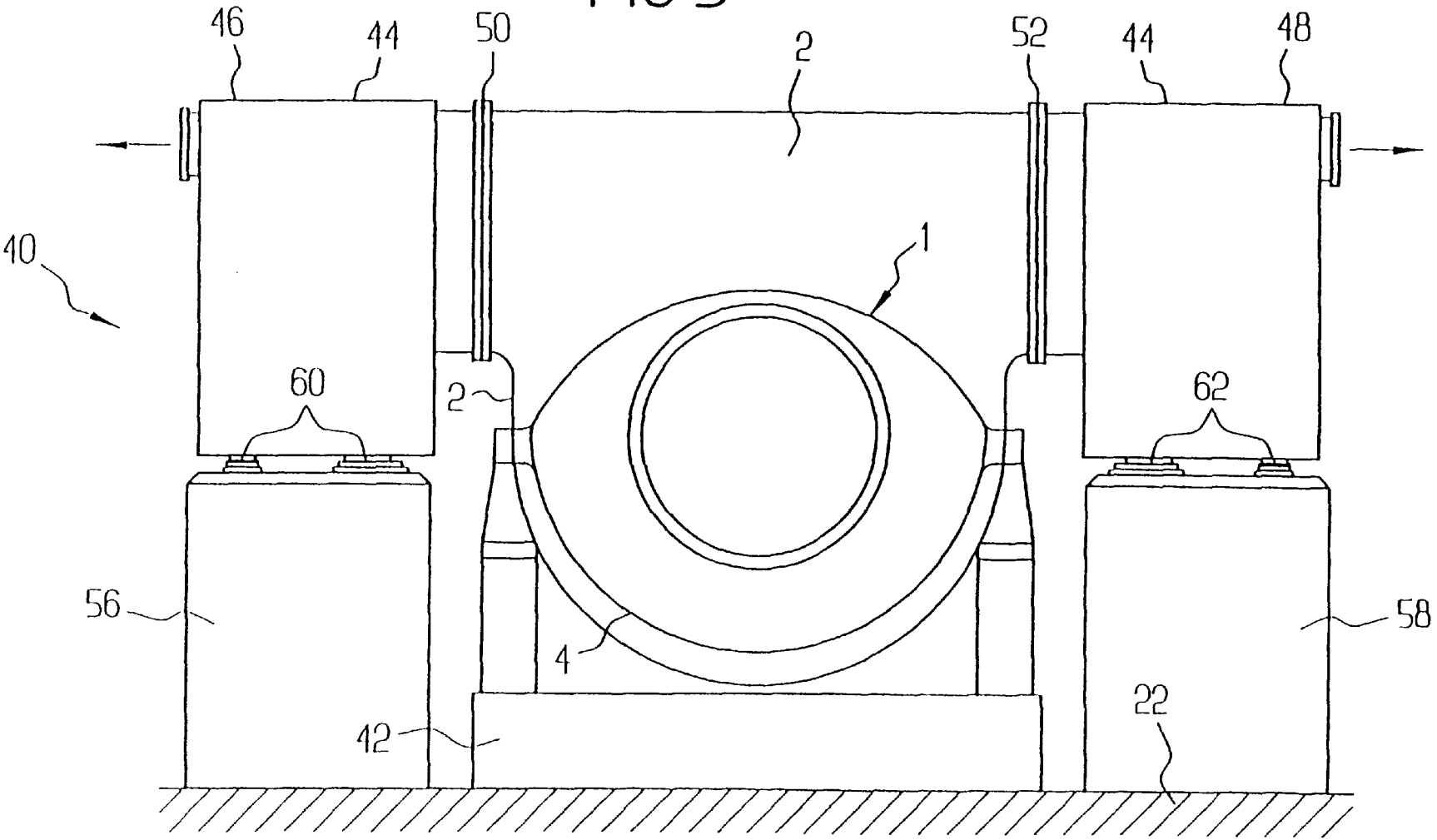
FIG. 3 is a schematic front view of a steam turbine installation.

The steam turbine 1 is part of a steam turbine installation 40, as illustrated schematically in FIG. 3. The lower housing component 4 of the exhaust steam housing 2 is arranged on a supporting frame 42, which in turn is fitted to the level foundation block 22 of a machine house (not specifically illustrated).

The steam turbine 1 is connected into a water/steam circuit (not specifically illustrated) of the steam turbine installation 40. Connected downstream of the steam turbine 1 in the water/steam circuit is a condenser 44 which, in the exemplary embodiment, comprises two condenser elements 46, 48. Alternatively, however, a different number of condenser elements can also be provided.

The condenser elements 46, 48 of the condenser 44 are in each case connected rigidly but detachably to the exhaust steam housing 2 of the steam turbine 1 via a flange 50, 52. In order to produce the rigid but detachable connections, a screw connection is provided on each flange 50, 52. The exhaust steam housing 2 is designed in such a way that all the outflow surfaces provided for the exhaust turbine steam to flow out are integrated in the upper housing component 6. Irrespective of the individual design of the steam turbine 1, a standardized component can therefore be used as the lower housing component 4.

In order to mount the condenser elements 46, 48 of the condenser 44, a bearing block 56 or 58 is provided, in each case arranged on the foundation block 22. The respective condenser element 46 or 48 is mounted on the respective bearing block 56, 58 by means of a number of supports 60 and 62, respectively, such that it can be displaced in the horizontal direction. The condenser 44 is therefore mounted such that it can be displaced on the foundation block 22. The height of the bearing blocks 56, 58 is such that the supports 60, 62 are arranged approximately at the geodetic level of the axis 14 of the turbine rotor 10 of the steam turbine 1. As a result of this arrangement, any occurrence of the vertical force components in the supports 60, 62 in the event of thermal stresses is largely avoided.

In the exemplary embodiment, the supports 60, 62 are multiple ball bearings. Alternatively or in addition, the supports 60, 62 can also be designed as elastomers or as swinging supports.

As a result of the displaceable mounting of the condenser elements 46, 48 of the condenser 44 on the foundation block 22, a level arrangement of the condenser 44, and therefore the erection of the condenser 44 without a cellar, is made possible in a particularly simple way. The forces occurring as a result of thermal expansions in the event of load changes on the steam turbine 1 are transmitted to the condenser elements 46, 48 via the rigid connections at the flanges 50, 52. As a result of the displaceable mounting, the forces result there in a horizontal displacement of the condenser elements 46, 48 and any noticeable stresses cannot occur. Even when the condenser 44 is erected without a cellar, damage arising from thermal expansion and thermal stress is therefore reliably avoided.

The frictional forces which occur during the horizontal displacement of the condenser elements 46, 48 are particularly low, because of the configuration of the bearing elements 50, 52.

The condenser elements 46, 48 are arranged opposite each other on the exhaust steam housing 2 of the steam turbine 1. The reaction forces which occur as a result of the horizontal displacement of the condenser elements 46, 48 arising from thermal expansion and acting on the exhaust steam housing 2 because of the frictional forces in the supports 60, 62 are virtually self-compensating because of the symmetrical arrangement. Any displacement of the upper part of the housing arising from thermal expansions is therefore reliably prevented.

We claim:

1. A steam turbine installation, comprising:

a steam turbine having an exhaust steam housing and a turbine rotor rotatably supported about a rotor axis in said exhaust steam housing;

a foundation block disposed below said exhaust steam housing and a support disposed on said foundation block and guided through and into said exhaust steam housing;

an end bearing rotatably supporting said turbine rotor on said support;

a plurality of supports disposed laterally of said exhaust steam housing substantially at an equal level with said rotor axis of said turbine rotor; and a condenser detachably and rigidly connected to said exhaust steam housing and mounted in said supports.

2. The steam turbine installation according to claim 1, wherein said exhaust steam housing includes a plurality of pads each mounted in a respective sliding bearing.

3. The steam turbine installation according to claim 1, wherein said supports are multiple ball bearings mounting said condenser.

4. The steam turbine installation according to claim 1, wherein said condenser comprises a plurality of condenser elements with at least one pair of condenser elements disposed opposite one another on said exhaust steam housing.

* * * * *